US008936515B2

(12) United States Patent
Yashiki

(10) Patent No.: US 8,936,515 B2
(45) Date of Patent: Jan. 20, 2015

(54) GOLF CLUB SHAFT

(75) Inventor: Tatsuya Yashiki, Kobe (JP)

(73) Assignee: SRI Sports Limited, Kobe (JP)

( * ) Notice: Subject to any disclaimer, the term of this patent is extended or adjusted under 35 U.S.C. 154(b) by 236 days.

(21) Appl. No.: 13/448,434

(22) Filed: Apr. 17, 2012

(65) Prior Publication Data

US 2012/0264536 A1 Oct. 18, 2012

(30) Foreign Application Priority Data

Apr. 18, 2011 (JP) ..... 2011-091831

(51) Int. Cl.
*A63B 53/10* (2006.01)

(52) U.S. Cl.
USPC ..... 473/319

(58) Field of Classification Search
USPC ..... 473/316, 319
See application file for complete search history.

(56) References Cited

U.S. PATENT DOCUMENTS

| | | | | |
|---|---|---|---|---|
| 5,427,373 | A * | 6/1995 | Kusumoto | 473/319 |
| 6,533,677 | B1 | 3/2003 | Sumitomo et al. | |
| 6,767,422 | B1 * | 7/2004 | Atsumi et al. | 156/184 |
| 6,773,358 | B1 * | 8/2004 | Sumitomo et al. | 473/319 |
| 6,953,402 | B2 * | 10/2005 | Oyama | 473/319 |
| 7,338,386 | B2 * | 3/2008 | Nakajima | 473/319 |
| 7,727,083 | B2 * | 6/2010 | Takeuchi | 473/319 |
| 2005/0090326 | A1 * | 4/2005 | Hasegawa | 473/319 |
| 2006/0258478 | A1 * | 11/2006 | Hsu | 473/316 |
| 2007/0238546 | A1 * | 10/2007 | Takeuchi | 473/319 |
| 2011/0294593 | A1 * | 12/2011 | Egelhoff | 473/319 |

FOREIGN PATENT DOCUMENTS

| | | | | |
|---|---|---|---|---|
| CN | 101380512 | A | 3/2009 | |
| JP | 11-33151 | A | 2/1999 | |
| JP | 2000093568 | A * | 4/2000 | A63B 53/10 |
| JP | 2002-137285 | A | 5/2002 | |
| JP | 3315338 | B2 | 8/2002 | |
| JP | 2004305332 | A * | 11/2004 | A63B 53/10 |
| JP | 2005-270515 | * | 10/2005 | |
| JP | 2005270515 | A * | 10/2005 | A63B 53/10 |
| JP | 2007-185253 | * | 7/2007 | |
| JP | 2007185253 | A * | 7/2007 | |
| JP | 2009-254401 | A | 11/2009 | |
| JP | 4510260 | B2 | 7/2010 | |

OTHER PUBLICATIONS

An English language abstract and machine-generated translation for Japanese Publication No. 2009-060983, published Mar. 26, 2009.

* cited by examiner

*Primary Examiner* — Stephen L. Blau
(74) *Attorney, Agent, or Firm* — Birch, Stewart, Kolasch & Birch, LLP

(57) ABSTRACT

A golf club shaft is manufactured using a plurality of prepreg sheets a1 to a8. The plurality of prepreg sheets a1 to a8 includes full length sheets a2 to a7 disposed all over in a shaft axis direction and partial sheets a1 and a8 partially disposed in the shaft axis direction. The number of plies is substantially an integer in all the full length sheets a2 to a7. The full length sheets a2 to a7 include four or more bias sheets a2 to a5. Circumferential winding start positions of the bias sheets a2 to a5 are dispersed in four or more positions. Preferably, the circumferential winding start positions of the full length sheets a2 to a7 are dispersed in five or more positions.

20 Claims, 8 Drawing Sheets

GOLF CLUB SHAFT

The present application claims priority on Patent Application No. 2011-91831 filed in JAPAN on Apr. 18, 2011, the entire contents of which are hereby incorporated by reference.

BACKGROUND OF THE INVENTION

1. Field of the Invention

The present invention relates to a golf club shaft.

2. Description of the Related Art

A so-called carbon shaft has been known as a golf club shaft. A sheet winding method has been known as a method for manufacturing the carbon shaft. In the sheet winding method, a laminated constitution is obtained by winding a prepreg (prepreg sheet) around a mandrel.

In the shaft, material error and error of a winding operation or the like may cause variation. In particular, the errors may cause circumferential variation. In particular, the error may cause variation in a flex (flexural rigidity) in a circumferential direction. When the variation exists, the flex is changed by a circumferential relative position (hereinafter, also referred to as a shaft position) of a shaft to a head. The variation may cause various problems.

A technique for improving circumferential uniformity is disclosed. Japanese Patent Application Publication No. 2705047 (U.S. Pat. No. 5,427,373) discloses a shaft having sheets having both end parts made abut on each other without overlapping both the end parts. The abutted portions are substantially equally dispersed in a circumferential direction. Japanese Patent No. 3315338 discloses a tubular body in which an overlapping part of adjacent layers is located on an opening part. The invention described in Japanese Patent No. 4510260 specifies that a winding end edge of a prepreg (P2) is made to abut on a winding start edge of a prepreg (P1).

Japanese Patent Application Laid-Open No. 2009-254401 discloses a shaft having a first angle layer and a second angle layer. The orientation angle of a fiber in the second angle layer is 60 degrees to 75 degrees with respect to the longitudinal direction of the shaft. It is an object of Japanese Patent Application Laid-Open No. 2009-254401 to improve torsional strength while maintaining the characteristic and the outer diameter of a conventional shaft.

On the other hand, a golf club having a head and a shaft attachable to and detachable from each other has been developed.

In the typical example of this type of golf club, a sleeve is bonded to a tip part of a shaft. The sleeve is engaged with a rotation preventing part of a head, and is locked by a screw. The shaft can be inclined to the sleeve in the golf club. The inclination enables adjustment of a loft angle, a lie angle, and a face angle. That is, the loft angle, the lie angle, and the face angle can be adjusted by changing a shaft position.

In this type of golf club, particularly, the variation of the shaft causes a problem. That is, it is not preferable that the flex is changed depending on the shaft position.

SUMMARY OF THE INVENTION

The appearance of the golf club having the head and the shaft attachable to and detachable from each other makes the circumferential uniformity more important.

It is an object of the present invention to provide a golf club shaft having excellent circumferential uniformity.

The golf club shaft according to the present invention is manufactured using a plurality of prepreg sheets. The plurality of prepreg sheets includes full length sheets disposed all over in a shaft axis direction and partial sheets partially disposed in the shaft axis direction. The number of plies is substantially an integer in all the full length sheets. The full length sheets include four or, more bias sheets. Circumferential winding start positions of the bias sheets are dispersed in four or more positions.

Preferably, circumferential winding start positions of the full length sheets are dispersed in five or more positions.

The partial sheets may include long partial sheets having a shaft axial length equal to or greater than 300 mm. In this case, preferably, the number of plies is substantially an integer in all the long partial sheets.

Preferably, the bias sheets have two base sheets (a first base sheet and a second base sheet) and two adjusting sheets (a first adjusting sheet and a second adjusting sheet). However, the two base sheets have an absolute fiber angle θb of 40 degrees or greater and 50 degrees or less. The two adjusting sheets have an absolute fiber angle θt of 15 degrees or greater and 75 degrees or less, and the angle θt is different from the angle θb.

When the circumferential winding start position of the first base sheet is defined as Pa; the circumferential winding start position of the second base sheet is defined as Pb; the circumferential winding start position of the first adjusting sheet is defined as Pc; and the circumferential winding start position of the second adjusting sheet is defined as Pd, each of the positions Pa, Pb, Pc, and Pd corresponds to any one of the following four circumferential positions P1 P2, P3, and P4 in a one-to-one manner;

the circumferential position P1: 0 degree;

the circumferential position P2: 75 degrees or greater and 105 degrees or less;

the circumferential position P3: 165 degrees or greater and 195 degrees or less; and the circumferential position P4: 255 degrees or greater and 285 degrees or less.

Preferably, the shaft is manufactured using an united sheet obtained by laminating four sheets. The four sheets are the two base sheets and the two adjusting sheets.

Preferably, the absolute fiber angle θt is less than the absolute fiber angle θb.

A golf club shaft according to another aspect is manufactured using a plurality of prepreg sheets. The plurality of prepreg sheets includes full length sheets disposed all over in a shaft axis direction and partial sheets partially disposed in the shaft axis direction. The full length sheets include a plurality of bias sheets. The bias sheets have two base sheets (a first base sheet and a second base sheet) and two adjusting sheets (a first adjusting sheet and a second adjusting sheet). The two base sheets have an absolute fiber angle θb of 40 degrees or greater and 50 degrees or less. The two adjusting sheets have an absolute fiber angle θt of 15 degrees or greater and 75 degrees or less, and the angle θt is different from the angle θb. When the circumferential winding start position of the first base sheet is defined as Pa; the circumferential winding start position of the second base sheet is defined as Pb; the circumferential winding start position of the first adjusting sheet is defined as Pc; and the circumferential winding start position of the second adjusting sheet is defined as Pd, each of the positions Pa, Pb, Pc, and Pd corresponds to any one of the following four circumferential positions P1 P2, P3, and P4 in a one-to-one manner:

the circumferential position P1: 0 degree;

the circumferential position P2: 75 degrees or greater and 105 degrees or less;

the circumferential position P3: 165 degrees or greater and 195 degrees or less; and the circumferential position P4: 255 degrees or greater and 285 degrees or less.

The golf club shaft having excellent circumferential uniformity can be obtained in the present invention.

DESCRIPTION OF THE PREFERRED EMBODIMENTS

Figure 1:
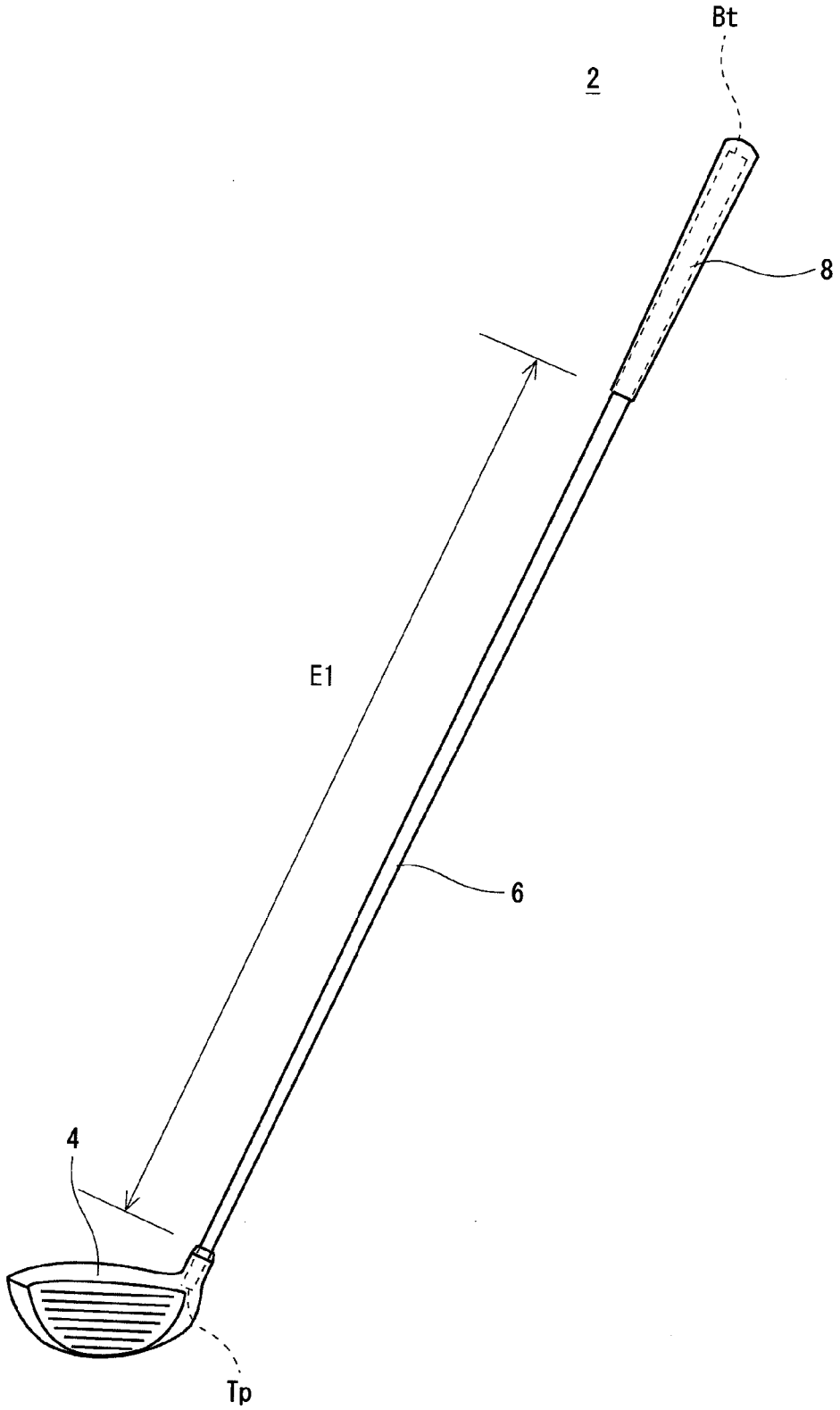
FIG. 1 shows a golf club provided with a shaft according to a first embodiment of the present invention.

Hereinafter, the present invention will be described in detail based on the preferred embodiments with appropriate references to the accompanying drawings.

The term "layer" and the term "sheet" are used in the present application. The "layer" is termed after being wound. On the other hand, the "sheet" is termed before being wound. The "layer" is formed by winding the "sheet". That is, the wound "sheet" forms the "layer".

In the present application, the same reference numeral is used in the layer and the sheet. For example, a layer formed by a sheet a1 is defined as a layer a1.

Unless otherwise described, in the present application, an "inside" means an inside in a radial direction of a shaft, and an "outside" means an outside in the radial direction of the shaft. Unless otherwise described, in the present application, the "radial direction" means the radial direction of the shaft, and an "axis direction" means a shaft axis direction.

FIG. 1 is an overall view of a golf club 2 provided with a golf club shaft 6 according to a first embodiment of the present invention. The golf club 2 is provided with a head 4, a shaft 6, and a grip 8. The head 4 is provided at the tip part of the shaft 6. The grip 8 is provided at the back end part of the shaft 6. The head 4 and the grip 8 are not restricted. Examples of the head 4 include a wood type golf club head, an iron type golf club head, and a putter head.

The shaft 6 includes a laminate of fiber reinforced resin layers. The shaft 6 is a tubular body. The shaft 6 has a hollow structure. As shown in FIG. 1, the shaft 6 has a tip Tp and a butt Bt. In the club 2, the tip Tp is located inside the head 4. In the club 2, the butt Bt is located inside the grip 8.

The shaft 6 is a so-called carbon shaft. The shaft 6 is preferably produced by curing the prepreg sheet. In the prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin. The matrix resin is preferably an epoxy resin.

The shaft 6 is preferably manufactured by a so-called sheet winding method. In the prepreg, the matrix resin is in a semicured state. The shaft 6 is obtained by winding and curing the prepreg sheet. The curing means the curing of the semicured matrix resin. The curing is attained by heating. Heating is performed in the curing process. The heating cures the matrix resin of the prepreg sheet.

Figure 2:
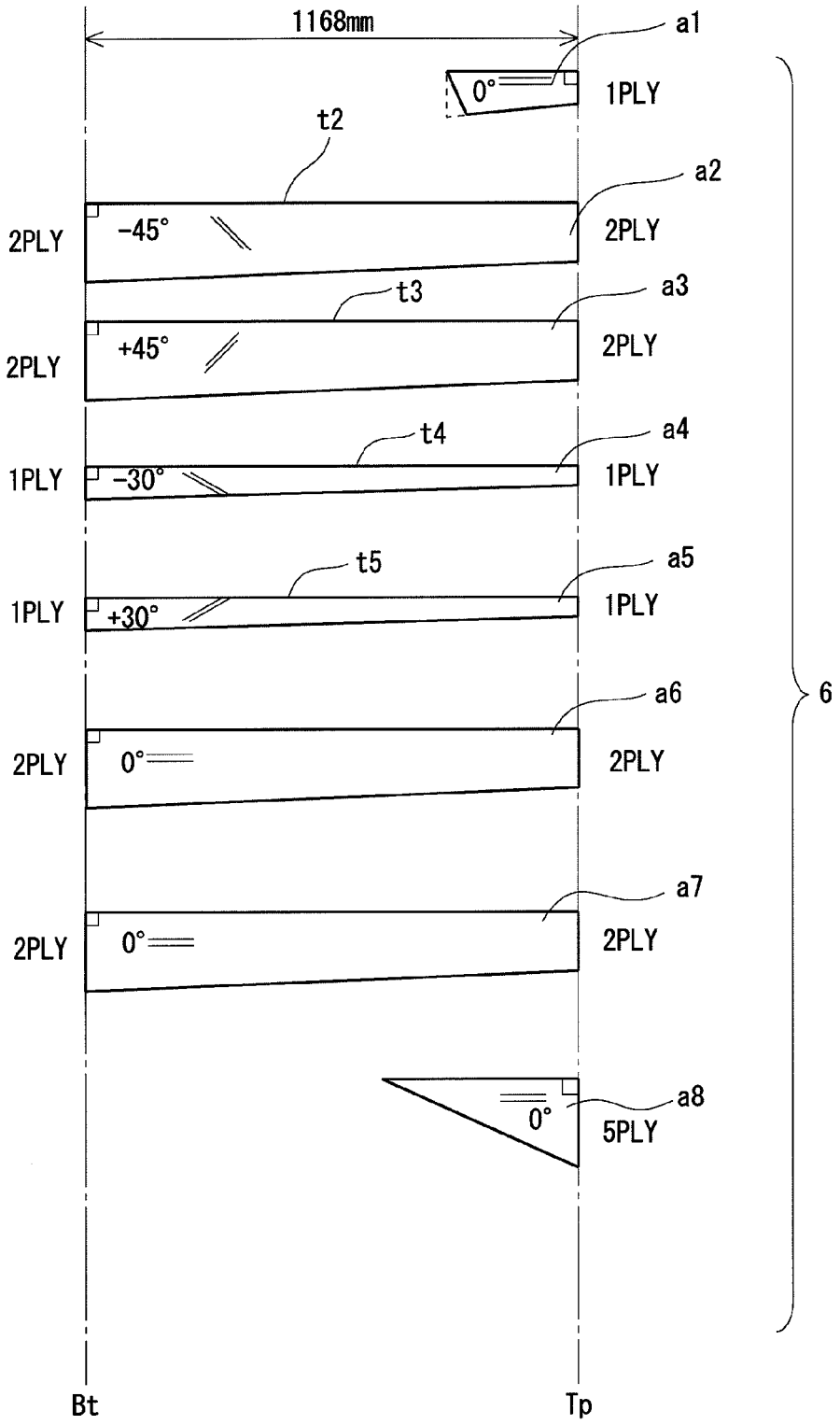
FIG. 2 is a developed view of the shaft according to the first embodiment.

FIG. 2 is a developed view (sheet constitution view) of the prepreg sheets constituting the shaft 6. The shaft 6 includes a plurality of sheets. In the embodiment of FIG. 2, the shaft 6 includes eight sheets a1 to a8. In the present application, the developed view shown in FIG. 2 shows the sheets constituting the shaft in order from the radial inner side of the shaft. The sheets are wound in order from the sheet located above in the developed view. In the developed view of the present application, the horizontal direction of the figure coincides with the axis direction. In the developed view of the present application, the right side of the figure is the tip Tp side of the shaft. In the developed view of the present application, the left side of the figure is the butt Bt side of the shaft.

The developed view of the present application shows not only the winding order of each of the sheets but also the disposal of each of the sheets in the axis direction. For example, in FIG. 2, one end of the sheet a1 is located at the tip Tp.

The shaft 6 has a straight layer and a bias layer. The orientation angle (fiber angle Af) of the fiber is described in the developed view of the present application. The orientation angle is an angle with respect to the axis direction. The axis direction is equal to a longitudinal direction of the shaft. A sheet described as "0 degree" constitutes the straight layer. The sheet for the straight layer is also referred to as a straight sheet in the present application.

The straight layer is a layer in which the orientation direction of the fiber is substantially 0 degree to the longitudinal direction (axis direction) of the shaft. The incompletely parallel orientation of the fiber to the axis direction is usually caused by error or the like in winding. In the straight layer, an absolute fiber angle θ to a shaft axis line is equal to or less than 10 degrees. The absolute fiber angle θ is an absolute value of an angle between the shaft axis line and the direction of the fiber. That is, the absolute fiber angle θ equal to or less than 10 degrees means that an angle Af (fiber angle Af) between the direction of the fiber and the axis direction is −10 degrees or greater and +10 degrees or less.

In the embodiment of FIG. 2, the straight sheets are the sheet a1, the sheet a6, the sheet a7, and the sheet a8. The straight layer is highly correlated with the flexural rigidity and flexural strength of the shaft.

The bias layer is a layer in which the orientation of the fiber is substantially inclined to the axis direction. In the present application, the sheet for the bias layer is also merely referred to as a bias sheet.

The bias layer is a combination of two layers in which the orientation directions of the fibers are inclined in opposite directions to each other. That is, the bias sheet is a combination of two sheets in which the orientation directions of the fibers are inclined in opposite directions to each other. Preferably, the bias sheet is a combination of a sheet having the angle Af of −75 degrees or greater and −15 degrees or less and a sheet having the angle Af of 15 degrees or greater and 75 degrees or less.

In the shaft 6, the bias sheets are the sheet a2, the sheet a3, the sheet a4, and the sheet a5. In FIG. 2, the angle Af is described in each sheet. The plus (+) and minus (−) in the angle Af show that the fibers of the bias sheets laminated to each other are inclined in opposite directions to each other.

In the embodiment of FIG. 2, the angle of the sheet a2 is −45 degrees and the angle of the sheet a3 is +45 degrees. However, conversely, it should be appreciated that the angle of the sheet a2 may be +45 degrees and the angle of the sheet a3 may be −45 degrees. Similarly, in the embodiment of FIG. 2, the angle of the sheet a4 is −30 degrees and the angle of the sheet a5 is +30 degrees. However, conversely, it should be appreciated that the angle of the sheet a4 may be +30 degrees and the angle of the sheet a5 may be −30 degrees.

Preferably, a hoop layer may be provided in addition to the straight layer and the bias layer. In the hoop layer, the absolute fiber angle θ is substantially set to 90 degrees. However, the angle θ is not completely set to 90 degrees by error or the like in winding. The absolute fiber angle θ in the hoop layer is preferably equal to or greater than 80 degrees, and more preferably equal to or greater than 85 degrees. In the embodiment of FIG. 2, the hoop layer is not provided.

The number of plies of each of the sheets is appended in FIG. 2. In FIG. 2, the number of plies in the tip Tp is described on the right side of the sheet. The number of plies in the butt Bt is described on the left side of the sheet.

The number of plies of the sheet a2 is 2. That is, the layer a2 is wound two times at all positions in the axis direction. The number of plies of the sheet a3 is 2. That is, the layer a3 is wound two times at all positions in the axis direction. The number of plies of the sheet a4 is 1. That is, the layer a4 is wound one time at all positions in the axis direction. The number of plies of the sheet a5 is 1. That is, the layer a5 is wound one time at all positions in the axis direction. The number of plies of the sheet a6 is 2. That is, the layer a6 is wound two times at all positions in the axis direction. The number of plies of the sheet a7 is 2. That is, the layer a7 is wound two times at all positions in the axis direction.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is laminated on one surface of the prepreg sheet, and the resin film is laminated on the other surface of the prepreg sheet. Hereinafter, the surface on which the mold release paper is laminated is also referred to as "a surface of a mold release paper side", and the surface on which the resin film is laminated is also referred to as "a surface of a film side".

Usually, in order to wind the prepreg sheet, the resin film is previously peeled. The surface of the film side is exposed by peeling the resin film. The exposed surface has tacking property (tackiness). The tacking property is caused by the matrix resin. That is, since the matrix resin is in a semicured state, the tackiness is developed. Next, the edge part of the exposed surface of the film side (also referred to as a winding start end part) is stuck on a wound object. The winding start end part can be smoothly stuck by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is previously peeled. Next, the winding start end part is stuck on the wound object, and the mold release paper is then peeled. The procedure suppresses wrinkles and winding fault of the sheet. This is because the sheet on which the mold release paper is laminated is supported by the mold release paper, and hardly causes wrinkles. The mold release paper has flexural rigidity higher than that of the resin film.

An united sheet is used in the embodiment of FIG. 2. The united sheet is formed by laminating a plurality of sheets.

Figure 3:
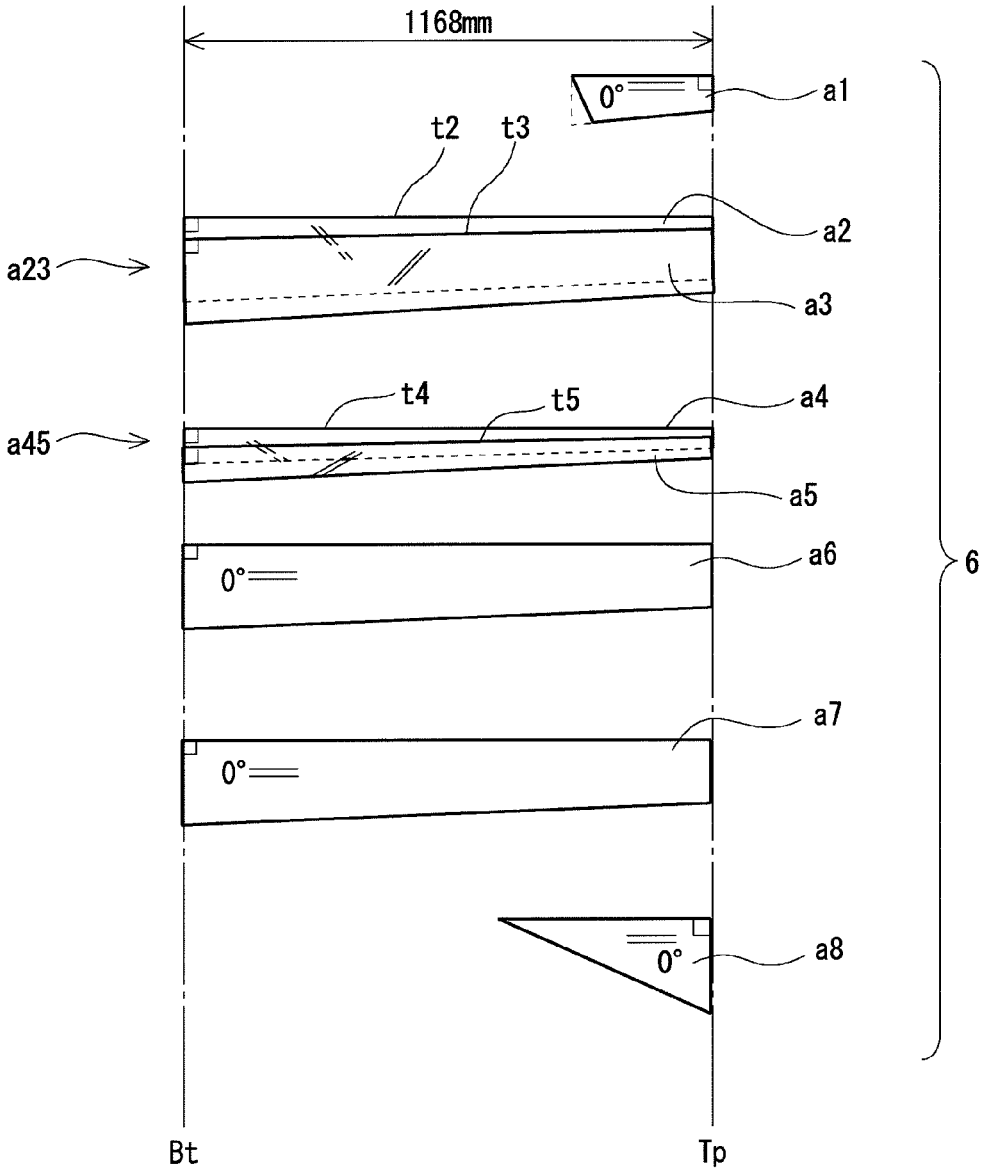
FIG. 3 is a developed view of the shaft according to the first embodiment, and shows a state where an united sheet is produced.

The two united sheets are formed in the embodiment of FIG. 2. FIG. 3 shows a sheet constitution after the two united sheets are formed.

As shown in FIG. 3, the sheet a2 and the sheet a3 are laminated, to form an united sheet a23. In the united sheet a23, a winding start end t2 of the sheet a2 and a winding start end t3 of the sheet a3 are deviated for a half circle. That is, in the section of the shaft after being wound, the circumferential position of the end t2 and the circumferential position of the end t3 are different from each other by 180 degrees.

As shown in FIG. 3, the sheet a4 and the sheet a5 are laminated, to form an united sheet a45. In the united sheet a45, a winding start end t4 of the sheet a4 and a winding start end t5 of the sheet a5 are deviated for a half circle. That is, in the section of the shaft after being wound, the circumferential position of the end t4 and the circumferential position of the end t5 are different from each other by 180 degrees.

In the present application, the sheet and the layer are classified based on the orientation angle of the fiber. In addition to the orientation angle, in the present application, the sheet and the layer are classified by the axial length.

In the present application, a layer disposed all over in the axis direction is referred to as a full length layer. In the present application, a sheet disposed all over in the axis direction is referred to as a full length sheet.

On the other hand, in the present application, a layer partially disposed in the axis direction is referred to as a partial layer. In the present application, a sheet partially disposed in the axis direction is referred to as a partial sheet.

These terms can be combined. For example, the bias layer covering the full length of the shaft is referred to as a full length bias layer. Similarly, terms such as a full length bias sheet, a full length straight layer, a full length straight sheet, a partial bias layer, a partial bias sheet, a partial straight layer, and a partial straight sheet are used.

In the shaft 6, the full length sheets are the sheets a2, a3, a4, a5, a6, and a7. The sheets a2, a3, a4, and a5 are the full length bias sheets. The sheets a6 and sheet a7 are the full length straight sheets. On the other hand, the partial sheets are the sheet a1 and the sheet a8. The sheet a1 and the sheet a8 are the partial straight sheets.

Next, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Laminating Process

A plurality of sheets is laminated in the laminating process, to produce the above-mentioned united sheet.

In the laminating process, heating or a press may be used. More preferably, the heating and the press is used in combination. In a winding process to be described later, the deviation of the sheet may be produced during the winding operation of the united sheet. The deviation reduces winding accuracy. The heating and the press improve an adhesive force between the sheets. The heating and the press suppress the deviation between the sheets in the winding process.

In respect of enhancing the adhesive force between the sheets, a heating temperature in the laminating process is preferably equal to or higher than 30° C., and more preferably equal to or higher than 35° C. When the heating temperature is too high, the curing of the matrix resin may be progressed, to reduce the tackiness of the sheet. The reduction of the tackiness reduces adhesion between the united sheet and the wound object. The reduction of the adhesion may allow the generation of wrinkles, to produce the deviation of a winding position. In this respect, the heating temperature in the laminating process is preferably equal to or less than 60° C., more preferably equal to or less than 50° C., and still more preferably equal to or less than 40° C.

In respect of enhancing the adhesive force between the sheets, a heating time in the laminating process is preferably equal to or greater than 20 seconds, and more preferably equal to or greater than 30 seconds. In respect of the tackiness of the sheet, the heating time in the laminating process is preferably equal to or less than 300 seconds.

In respect of enhancing the adhesive force between the sheets, a press pressure in the laminating process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value. In respect of thickness accuracy of the prepreg, the press pressure in the laminating process is preferably equal to or less than 600 g/cm$^2$, and more preferably equal to or less than 500 g/cm$^2$.

In respect of enhancing the adhesive force between the sheets, a press time in the laminating process is preferably equal to or greater than 20 seconds, and more preferably equal to or greater than 30 seconds. In respect of the thickness accuracy of the prepreg, the press time in the laminating process is preferably equal to or less than 300 seconds.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the sticking of the winding start end part of the sheet on the mandrel.

The laminated sheets are wound in a state of the united sheet. That is, each of the sheets having a state of FIG. 3 is wound.

A winding body is obtained by the winding process. The winding body is obtained by wrapping the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The wrapping tape is wrapped while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not restricted. However, the process of removing the wrapping tape is preferably performed after the process of extracting the mandrel in respect of improving the efficiency of the process of removing the wrapping tape.

(7) Process of Cutting Both Ends

The both end parts of the cured laminate are cut in the process. The cutting flattens the end face of the tip Tp and the end face of the butt Bt.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to smooth the surface of the cured laminate.

(9) Coating Process

The cured laminate after the polishing process is subjected to coating.

Figure 4:
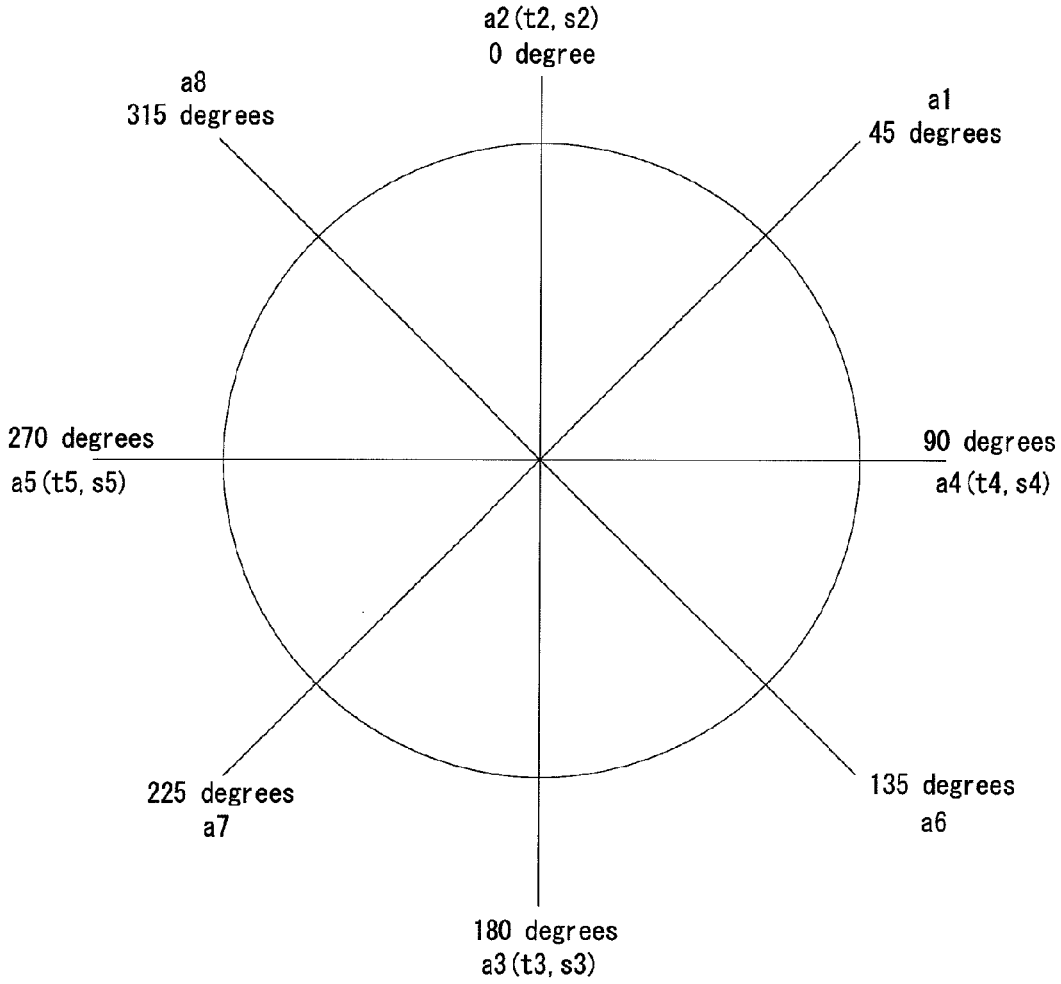
FIG. 4 shows circumferential winding start positions of sheets in the first embodiment.

FIG. 4 shows circumferential winding start positions of the sheets. FIG. 4 shows the shaft, as viewed from the butt Bt side. In the present application, the circumferential winding start position is merely also referred to as a winding start position. The winding start position is a position of the above-mentioned winding start end. The winding start positions of the four bias sheets are different from each other. Therefore, the winding start positions of the bias sheets are dispersed in four positions. As shown in FIG. 4, the winding start positions s2, s3, s4, and s5 of the four bias sheets are disposed at intervals of 90 degrees. However, error of ±15 degrees can be allowed.

Figure 5:
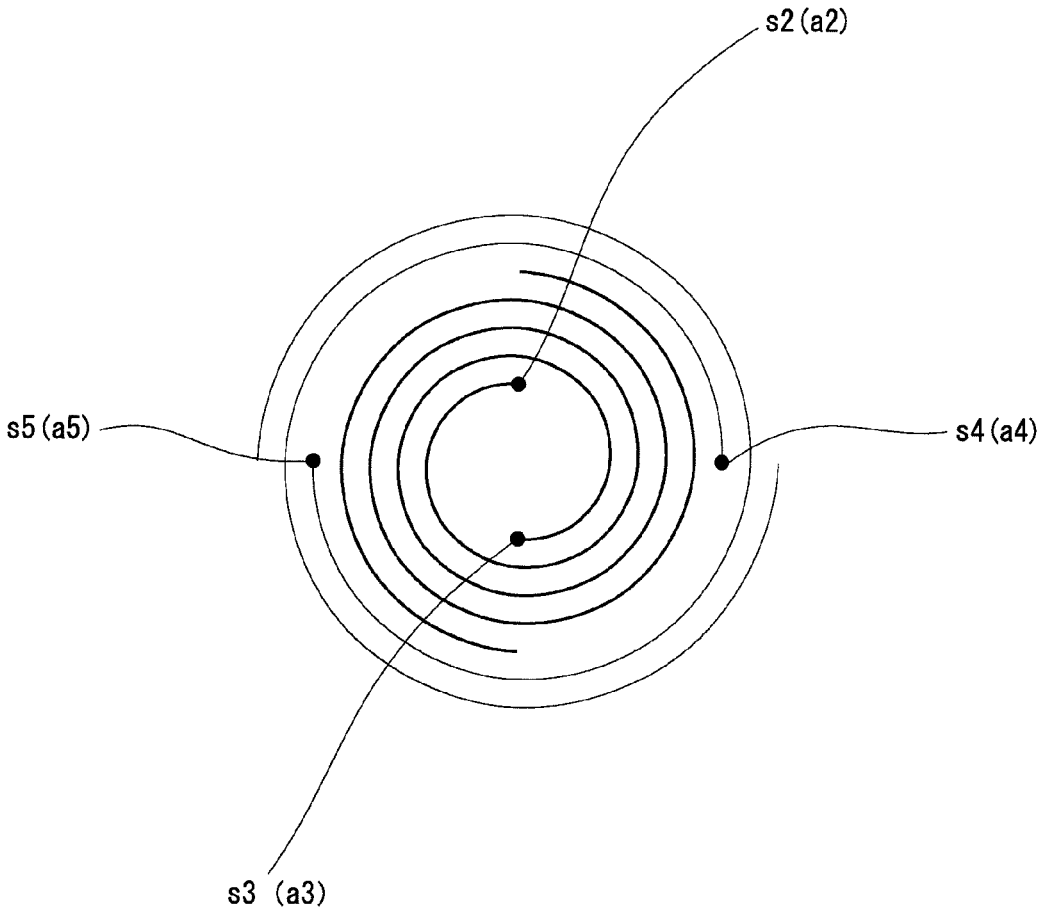
FIG. 5 is a conceptual view showing a laminated constitution of bias layers in the first embodiment.

FIG. 5 is a schematic sectional view showing the constitutions of the bias layers. Each of the layers is simply expressed by one line. FIG. 5 shows the shaft, as viewed from the butt Bt side. As shown in FIG. 3, the united sheet a23 is first wound, and the united sheet a45 is then wound. The winding start position of the united sheet a45 is different by 90 degrees from the winding start position of the united sheet a23. As a result, the lamination shown in FIG. 5 is obtained. The winding start position of the sheet a2 is shown by reference numeral s2. The winding start position of the sheet a3 is shown by reference numeral s3. The winding start position of the sheet a4 is shown by reference numeral s4. The winding start position of the sheet a5 is shown by reference numeral s5.

As shown in FIGS. 4 and 5, when the winding start position s2 is defined as 0 degree, the winding start position s3 is 180 degrees (±15 degrees); the winding start position s4 is 90 degrees (±15 degrees); and the winding start position s5 is 270 degrees (±15 degrees). Since the winding start positions are dispersed in the circumferential direction, the shaft 6 has excellent flex uniformity in the circumferential direction.

These angles can be defined as circumferential angles when the shaft is viewed from the butt Bt side. As shown in FIG. 4, the angles are defined as clockwise angles when the shaft is viewed from the butt Bt side.

In order to realize the laminated constitution shown in FIG. 5, in the embodiment, the sheet a2 and the sheet a3 were laminated with a deviation width corresponding to 180 degrees (±15 degrees), to produce the united sheet a23. The sheet a4 and sheet a5 were laminated with a deviation width corresponding to 180 degrees (±15 degrees), to produce the united sheet a45. Furthermore, the difference between the winding start position of the united sheet a23 and the winding start position of the united sheet a45 is set to 90 degrees (±15 degrees).

In the embodiment, the number of plies is substantially set to an integer in all the full length sheets (a2, a3, a4, a5, a6, and a7). Therefore, the uniformity of the lamination is improved, and the flex uniformity in the circumferential direction is enhanced.

"The number of plies is substantially an integer" (integer ply) means that the number of plies is (X−0.02) or greater and (X+0.10) or less. X is an integer equal to or greater than 1. For example, when the number of plies is 1, "substantially an integer" means 0.98 or greater and 1.10 or less. For example, when the number of plies is 2, "substantially an integer" means that the number of plies is 1.98 or greater and 2.10 or less. In respect of shaft strength, preferably "the number of plies is substantially an integer" means the following item (1a), more preferably the following item (1b), and still more preferably the following item (1c):

(1a) the number of plies is (X−0.01) or greater and (X+0.10) or less;

(1b) the number of plies is (X−0.00) or greater and (X+0.10) or less;

(1c) the number of plies is (X−0.00) or greater and (X+0.05) or less; and (1d) the number of plies is greater than (X−0.00) and (X+0.05) or less.

When the number of plies is equal to or greater than (X−0.00), a gap caused by circumference shortage is hardly formed. Thereby, the number of plies equal to or greater than (X−0.00) is advantageous in strength. On the other hand, when the number of plies is equal to or greater than (X−0.00), an overlapping part of the winding start end and the winding finish end is apt to be formed. The overlapping part may deteriorate the circumferential uniformity. However, the winding start positions are dispersed in the circumferential direction, and thereby the circumferential uniformity can be improved even if the overlapping part is formed. Therefore, the present invention is particularly effective in the cases of the above items (1c) and (1d).

In respect of enhancing the availability of the present invention, a range (a range in the axis direction) satisfying integer ply in the full length sheet is preferably equal to or greater than 85% of the full length of the shaft, more preferably equal to or greater than 90%, still more preferably equal to or greater than 95%, yet still more preferably equal to or greater than 98%, and particularly preferably 100%. On the other hand, in respect of relaxing stress concentration in the partial sheet, a portion of non-integer ply is preferably provided. Therefore, in respect of achieving both the relaxation of flexural stress and the circumferential uniformity, the range satisfying the integer ply is preferably 85% or greater and less than 100% of the sheet full length of the partial sheet in the partial sheet (except for a triangular sheet). Typically, the triangular sheet is disposed in the tip part of the shaft in order to adjust the tip diameter of the shaft.

The integer ply in the full length sheet is preferably satisfied in an entire exposed part E1 of the shaft. The exposed part E1 means a portion which is not covered with members (a grip, a ferrule, and a head or the like) other than the shaft (see FIG. 1). The exposed part E1 is related greatly to the behaviors (deflection and torsion or the like) of the shaft during a swing. Therefore, when the integer ply of the full length sheet is satisfied in the entire exposed part E1, the flex uniformity in the circumferential direction is effectively attained.

As described above, in the shaft 6, the six full length sheets (the sheets a2 to a7) are used. In the shaft 6, the winding start positions of the full length sheets are dispersed in five or more positions. Specifically, the winding start positions of the full length sheets are dispersed in six positions. The dispersion of the winding start positions improves the flex uniformity in the circumferential direction.

As shown in FIG. 4, the winding start positions are different in all the full length sheets (a2 to a7). In all the full length sheets, the winding start positions are different by equal to or greater than 45 degrees (±15 degrees). Even if winding error is considered, the winding start positions are different by equal to or greater than 40 degree (±15 degrees) in all the full length sheets. The dispersion of the winding start positions improves the flex uniformity in the circumferential direction.

As described above, eight sheets are used in the shaft 6. As shown in FIG. 4, the winding start positions are different in all the sheets (a1 to a8). In all the sheets, the winding start positions are different by equal to or greater than 45 degrees. Even if winding error is considered, the winding start positions are different by equal to or greater than 40 degrees in all the sheets. The dispersion of the winding start positions improves the flex uniformity in the circumferential direction As shown in FIG. 4, the winding start positions of the shaft 6 are set to eight positions. When the winding start positions are excessively dispersed, the work burden of the winding process is increased. In respect of workability, the winding start positions are preferably equal to or less than eight positions.

In the present application, the partial sheets are classified into short partial sheets of less than 300 mm and long partial sheets of equal to or greater than 300 mm. Lengths thereof are axial lengths. Preferably, the number of plies is substantially set to an integer in all the long partial sheets in addition to all the full length sheets. In this case, the flex uniformity in the circumferential direction can be further improved.

In the embodiment of FIG. 2, the bias sheets have the base sheets a2 and a3 (the first base sheet a2 and the second base sheet a3), and the adjusting sheets a4 and a5 (the first adjusting sheet a4 and the second adjusting sheet a5). The base sheet is a sheet having an absolute fiber angle θb of 40 degrees or greater and 50 degrees or less. The absolute fiber angle θt of the adjusting sheet is 15 degrees or greater and 75 degrees or less, and the absolute fiber angle θt is different from the absolute fiber angle θb.

The layer formed by the base sheet (base bias sheet) is a base layer (base bias layer). The layer formed by the adjusting sheet (adjusting bias sheet) is an adjusting layer (adjusting bias layer).

The base sheet is a combination of two sheets a2 and a3 in which the inclination angles Af of the fibers are opposite to each other. For example, when the angle Af of the first base sheet a2 is −50 degrees or greater and −40 degrees or less, the angle Af of the second base sheet a3 is 40 degrees or greater and 50 degrees or less.

The adjusting sheet is a combination of two sheets a4 and a5 in which the inclination angles Af of the fibers are opposite to each other. For example, when the angle Af of the first adjusting sheet a4 is −75 degrees or greater and −50 degrees or less, the angle Af of the second adjusting sheet a5 is greater than 50 degrees and 75 degrees or less. For example, when the angle Af of the first adjusting sheet a4 is greater than −40 degrees and −15 degrees or less, the angle Af of the second adjusting sheet a5 is 15 degrees or greater and less than 40 degrees.

In the present application, the winding start position of the first base sheet a2 is defined as Pa; the winding start position of the second base sheet a3 is defined as Pb; the winding start position of the first adjusting sheet a4 is defined as Pc; and the winding start position of the second adjusting sheet a5 is defined as Pd. In the shaft 6, each of the positions Pa, Pb, Pc, and Pd corresponds to any one of the following four circumferential positions P1 P2, P3, and P4 in a one-to-one manner:

the circumferential position P1: 0 degree;

the circumferential position P2: 75 degrees or greater and 105 degrees or less (90 degrees±15 degrees);

the circumferential position P3: 165 degrees or greater and 195 degrees or less (180 degrees±15 degrees); and the circumferential position P4: 255 degrees or greater and 285 degrees or less (270 degrees±15 degrees).

In the embodiment of FIG. 4, a one-to-one correspondence relation is expressed as follows.

(Pa, P1), (Pc, P2), (Pb, P3) (Pd, P4)

This correspondence relation is only an example. All combinations are possible.

More preferably, when the position Pa corresponds to the position P1, the position Pb corresponds to the position P3; the position Pc corresponds to one of the position P2 and the position P4; and the position Pd corresponds to the other of the position P2 and the position P4. Since the base sheets and the adjusting sheets can be alternately disposed in the circumferential direction in the disposal, the circumferential uniformity is improved.

In the adjusting sheets (adjusting layers) a4 and a5, the angle θt can be adjusted. The angle adjustment can finely adjust shaft specifications while substantially setting the number of plies of the bias layer to an integer. Examples of the shaft specifications capable of being finely adjusted include a shaft torque, a flex, a shaft weight, flexural strength, and torsional strength.

When the number of plies of the bias sheet is substantially set to an integer, the number of plies cannot be finely adjusted. Therefore, in this case, the shaft specifications cannot be finely adjusted depending on the number of plies. However, the provision of the adjusting sheet can finely adjust the shaft specifications while substantially maintaining the number of plies.

Figure 6:
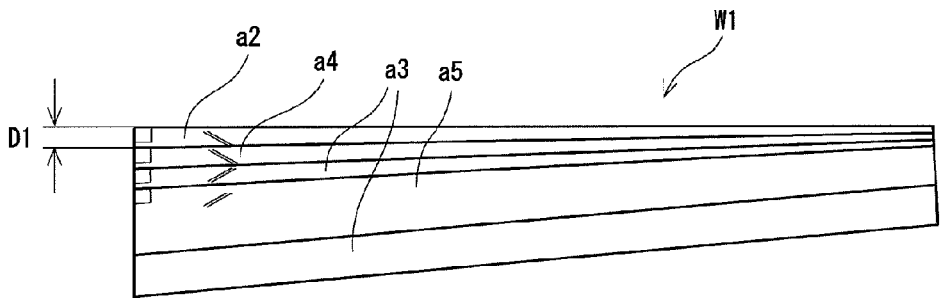
FIG. 6 shows an united sheet used in a second embodiment.

FIG. 6 shows an united sheet in a shaft according to a second embodiment. In the second embodiment, an united sheet W1 is produced using four bias sheets.

The united sheet W1 is obtained by laminating two base sheets a2 and a3 and two adjusting sheets a4 and a5. That is, the united sheet W1 is formed by laminating the four sheets. In the laminating, a deviation width D1 of the sheet end is a width corresponding to 0.25 ply. Although the deviation width D1 corresponds to 90 degrees in the circumferential direction, error of ±15 degrees is allowed. The deviation width D1 is adjusted based on the winding start position of each of the sheets.

Figure 7:
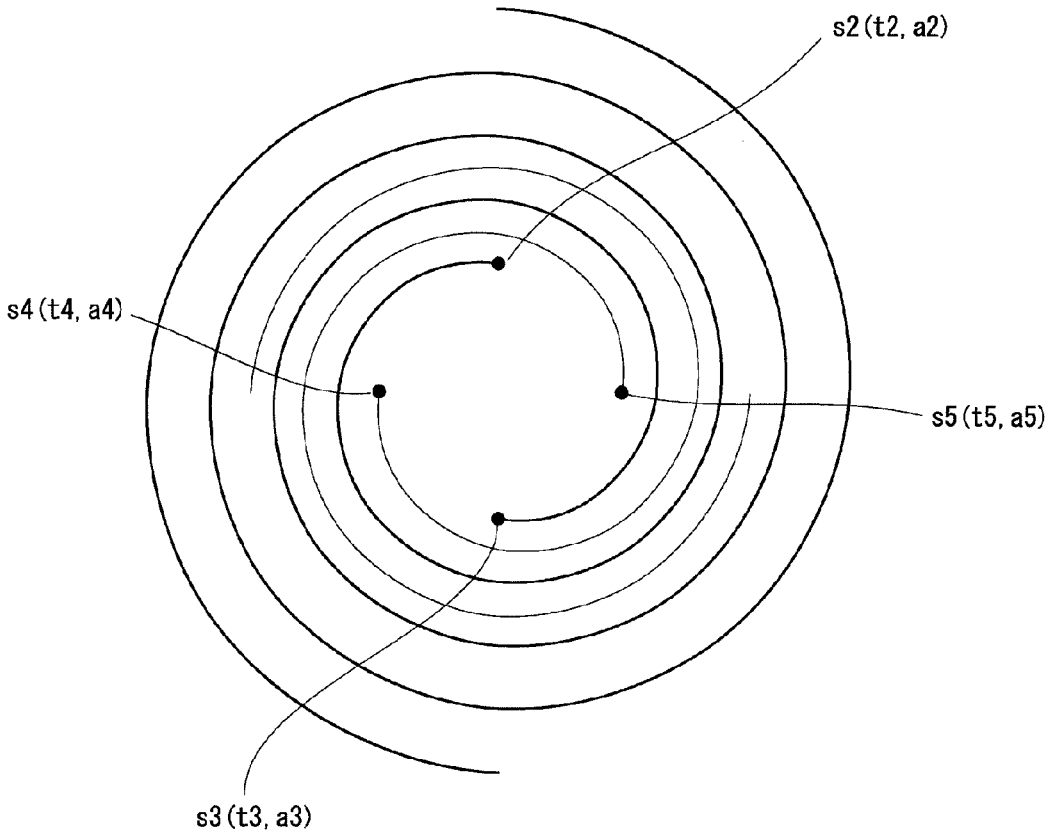
FIG. 7 is a conceptual view showing a laminated constitution of bias layers in the second embodiment.

FIG. 7 is a conceptual view showing a laminated constitution of bias layers in the second embodiment. FIG. 7 shows the shaft, as viewed from the butt Bt side. The laminated constitution of FIG. 7 is obtained by winding the united sheet W1. The laminated constitution of FIG. 7 is different from the laminated constitution of FIG. 5. In the circumferential disposal, FIG. 5 is substantially equivalent to FIG. 7. However, in the radial disposal, FIG. 5 is different from FIG. 7. The radial disposal of the constitution of FIG. 7 is different from that of the constitution of FIG. 5. For example, in the constitution of FIG. 7, each of four winding start positions s2, s3, s4, and s5 is located on the innermost side. In the constitution of FIG. 7, the difference between the radial positions of the four bias layers is small. Therefore, the constitution of FIG. 7 further enhances the uniformity of the shaft.

The four bias sheets can be simultaneously wound by using the united sheet W1. Therefore, the efficiency of a winding process is improved.

In the embodiment of FIG. 6, the laminating order is an order of the sheet a2, the sheet a4, the sheet a3, and the sheet a5. That is, the base sheets and the adjusting sheets are alternately laminated. The following items (X), (Y), and (Z) can be attained by the alternate laminating:

(X) the difference between the winding start positions of the two base sheets is set to 180 degrees;

(Y) the difference between the winding start positions of the two adjusting sheets is set to 180 degrees; and (Z) the four bias sheets are equally disposed in four positions in the circumferential direction.

Therefore, the alternate laminating contributes to the increase of the circumferential uniformity.

In the united sheet W1, a fiber in the sheet a2 and a fiber in the sheet a4 are inclined in the same direction with respect to a shaft axis line. Furthermore, in the united sheet W1, a fiber in sheet a3 and a fiber in the sheet a5 are inclined in the same direction with respect to the shaft axis line. The base sheets and the adjusting sheets are alternately laminated, and thereby the bias layers inclined in the same direction tends to be brought into contact with each other. The interlayer adhesive strength between the bias layers inclined in the same direction tends to be improved.

The absolute fiber angle θt of the adjusting sheet is different from the absolute fiber angle θb of the base sheet. The difference enables fine adjustment of the shaft specifications.

More preferably, the absolute fiber angle θt is less than the absolute fiber angle θb. In this case, the adjusting sheet effectively contributes to improvement in flexural rigidity of the shaft. Therefore, a lightweight shaft having high flexural rigidity can be attained.

In another preferred aspect, the absolute fiber angle θt of the adjusting sheet is any one of the following items:

(a) 15 degrees or greater and less than 40 degrees; and (b) greater than 50 degrees and 75 degrees or less.

In this case, the difference between the absolute fiber angle θt and the absolute fiber angle θb can be expanded, to expand the adjusting range of the shaft specifications. In respect of obtaining the lightweight shaft having high flexural rigidity, the absolute fiber angle θt of the adjusting sheet is preferably 15 degrees or greater and less than 40 degrees.

The disposals of the base bias layer and the adjusting bias layer are not restricted. As in the above-mentioned embodiment, the base bias layer may be on the inner side of the adjusting bias layer. The adjusting bias layer may be on the inner side of the base bias layer. Furthermore, as shown in FIG. 7, the adjusting bias layers and the base bias layers may be alternately disposed.

The radial position may influence the performance of the bias layer. In respect of the uniformity of the shaft specifications, the radial position of the base bias layer is preferably close to the radial position of the adjusting bias layer. In this respect, the base bias layer and the adjusting bias layer are preferably brought into contact with each other.

In the adjusting bias layer and the base bias layer, an elastic modulus of a carbon fiber is not restricted. In respect of enhancing torsional breaking strength, the elastic modulus of the carbon fiber of the adjusting bias layer is preferably less than the elastic modulus of the carbon fiber of the base bias layer.

In respect of enhancing the circumferential uniformity, the winding start positions of the bias sheets are preferably dispersed. The winding start positions of the bias sheets are preferably dispersed in four or more positions. When the winding start positions of the bias sheets are M positions, it is preferable that the M positions are equally dispersed in the circumferential direction. Error of ±15 degrees is allowed in the equal dispersion. M is an integer equal to or greater than 4. In respect of enhancing the working efficiencies of the cutting process and the winding process, M is preferably equal to or less than eight.

In respect of enhancing the circumferential uniformity, the winding start positions are preferably dispersed for all the sheets. The winding start positions in all the sheets are preferably dispersed in four or more positions, more preferably five or more positions, and still more preferably six or more positions. In the embodiment of FIG. 2, the winding start positions in all the sheets are eight positions (see FIG. 4).

In addition to the epoxy resin, a thermosetting resin other than the epoxy resin and a thermoplastic resin or the like may be also used as the matrix resin of the prepreg sheet. In respect of the shaft strength, the matrix resin is preferably the epoxy resin.

EXAMPLES

Hereinafter, the effects of the present invention will be clarified by examples. However, the present invention should not be interpreted in a limited way based on the description of examples.

Example 1

A shaft having the same laminated constitution as that of the above-mentioned first embodiment (shaft 6) was produced. Sheets shown in FIG. 2 were obtained by the cutting process. The sheets were laminated as shown in FIG. 3. That is, a base sheet a2 and a base sheet a3 were laminated so that the base sheet a2 and the base sheet a3 were deviated for 180 degrees (±15 degrees) in a circumferential direction, to obtain an united sheet a23. An adjusting sheet a4 and an adjusting sheet a5 were laminated so that the adjusting sheet a4 and the adjusting sheet a5 were deviated for 180 degrees (±15 degree) in the circumferential direction, to obtain an united sheet a45. The winding start position of the united sheet a23 and the winding start position of the united sheet a45 were made to differ by 90 degrees in the winding process. As these results, the constitution of bias layers as shown in FIG. 5 was obtained. The winding start positions of the eight sheets were dispersed in eight positions as shown in FIG. 4. After the winding process, the tape wrapping process, the curing process, the process of extracting a mandrel, the process of removing the wrapping tape, the process of cutting both ends, and the polishing were performed, to obtain a shaft according to example 1. The laminated constitution of the shaft of example 1 and a trade name of a prepreg used are shown in the following Table 1. All the prepregs are manufactured by MITSUBISHI RAYON CO., LTD. The evaluation results of the shaft are shown in the following Table 3

Example 2

Laminating was performed as shown in FIG. 6. That is, four bias sheets a2, a3, a4, and a5 were laminated, to obtain an united sheet. The united sheet was wound to obtain a laminated constitution shown in FIG. 7. Winding start positions were dispersed in eight positions at intervals of 45 degrees. The winding start positions of the sheets were substantially made equivalent to those of FIG. 4. A shaft of example 2 was obtained in the same manner as in example 1 except for above. The laminated constitution of the shaft of example 2 and a trade name of a prepreg used are shown in the following Table 1. The evaluation results of the shaft are shown in the following Table 3.

Example 3

A shaft of example 3 was obtained in the same manner as in example 1 except that the fiber angle Af of an adjusting sheet was changed to ±25 degrees from ±30 degrees. The laminated constitution of the shaft of example 3 and a trade name of a prepreg used are shown in the following Table 1. The evaluation results of the shaft are shown in the following Table 3.

Example 4

The prepreg of an adjusting sheet was changed to "MR350C-100S" from "MRX350C-75R". The fiber angle Af of the adjusting sheet was changed to ±25 degrees from ±30 degrees. A shaft of example 4 was obtained in the same manner as in example 1 except for above. The laminated constitution of the shaft of example 4 and a trade name of a prepreg used are shown in the following Table 1. The evaluation results of the shaft are shown in the following Table 3.

Comparative Example 1

Only two bias sheets were used. The fiber angle Af of the bias sheet was set to ±45 degrees. The winding start positions of the bias sheets were set to 0 degree and 180 degrees. Sheets other than the bias sheets were made the same as those of example 1. That is, the sheet a1, the sheet a6, the sheet a7, and the sheet a8 which were shown in FIG. 2, were used. The winding start position of the sheet a1 was set to 0 degree. The winding start position of the sheet a6 was set to 0 degree. The winding start position of the sheet a7 was set to 90 degrees. The winding start position of the sheet a8 was set to 270 degrees. A shaft of comparative example 1 was obtained in the same manner as in example 1 except for above. The laminated constitution of the shaft of comparative example 1 and a trade name of a prepreg used are shown in the following Table 2. The evaluation results of the shaft are shown in the following Table 3.

Comparative Example 2

A prepreg of a bias sheet was changed to "HRX350C-110S" from "HRX350C-130S". A prepreg of a full length straight sheet (sheets a6 and a7) was changed to a type having a great fiber weight basis amount. A shaft of comparative example 2 was obtained in the same manner as in example 1 except for above. The laminated constitution of the shaft of comparative example 2 and a trade name of the prepreg used are shown in the following Table 2. The evaluation results of the shaft are shown in the following Table 3.

Comparative Example 3

Sheets shown in FIG. 2 were obtained by the cutting process. That is, the sheets used were made the same as those of example 1. Laminating was performed as shown in FIG. 3. That is, the laminating was also made the same as that of example 1. In the winding process, the winding start position of an united sheet a23 and the winding start position of an united sheet a45 were made the same. As these results, the winding start positions of the sheet a2 and the sheet a4 were set to 0 degree, and the winding start positions of the sheet a3 and the sheet a5 were set to 180 degrees. The winding start positions of the sheets were set as shown in FIG. 4 except for the bias sheets a2 to a5. The winding start positions of the eight sheets were dispersed in four positions. A shaft of comparative example 3 was obtained in the same manner as in example 1 except for above. The laminated constitution of the shaft of comparative example 3 and a trade name of a prepreg used are shown in the following Table 2. The evaluation results of the shaft are shown in the following Table 3.

[Evaluation Methods]

[Measurement of Forward Flex]

Figure 8A:
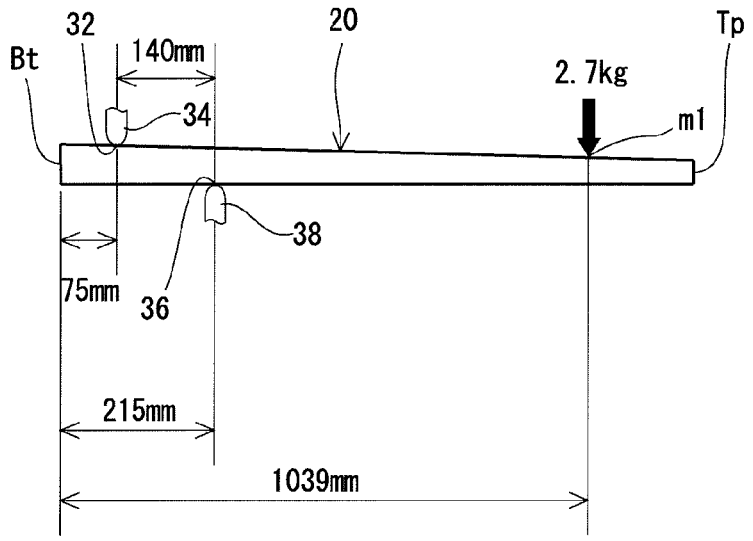
FIG. 8A shows a method for measuring a forward flex.

FIG. 8A describes a method for measuring a forward flex. As shown in FIG. 8A, a first supporting point 32 was set at a position which was 75 mm away from a butt Bt. Furthermore, a second supporting point 36 was set at a position which was 215 mm away from the butt Bt. A support 34 supporting the shaft 20 from the upside was provided at the first supporting point 32. A support 38 supporting the shaft 20 from the underside was provided at the second supporting point 36. In a state where no load was applied, the shaft axial line of the shaft 20 was substantially horizontal. At a load point m1 which was positioned 1039 mm away from the butt Bt, a load of 2.7 kg was allowed to act in a vertical downward direction. A travel distance (mm) of the load point m1 between the state where no load was applied and a state where a load was applied was determined as the forward flex. The travel distance is a travel distance along the vertical direction.

The section shape of a portion (hereinafter, referred to as an abutting portion) of the support 34 abutting on the shaft is as follows. The section shape of the abutting portion of the support 34 has convex roundness in a section parallel to an axis direction. The curvature radius of the roundness is 15 mm. The section shape of the abutting portion of the support 34 has concave roundness in a section perpendicular to the axis direction. The curvature radius of the concave roundness is 40 mm. The horizontal length (a length in a depth direction in FIG. 8A) of the abutting portion of the support 34 is 15 mm in the section perpendicular to the axis direction. The section shape of the abutting portion of the support 38 is the same as that of the support 34. The section shape of the abutting portion of a load indenter (not shown) applying a load of 2.7 kg in the load point m1 has convex roundness in the section parallel to the axis direction. The curvature radius of the roundness is 10 mm. The section shape of the abutting portion of a load indenter (not shown) applying a load of 2.7 kg in the load point m1 is a straight line in the section perpendicular to the axis direction. The length of the straight line is 18 mm. Thus, the forward flex was measured.

[Flex Difference of Forward Flex]

The forward flex was measured in four directions (0 degree, 45 degrees, 90 degrees, and 135 degrees). The difference between the maximum value and the minimum value of the obtained data is a flex difference. The less the flex difference is, the higher the uniformity of the forward flex in the circumferential direction is. The flex difference is shown in the following Table 3.

[Measurement of Backward Flex]

Figure 8B:
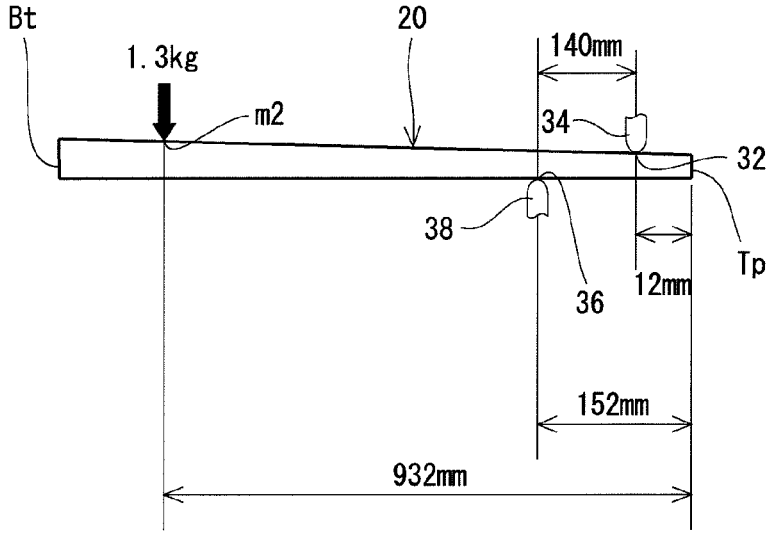
FIG. 8B shows a method for measuring a backward flex.

A measuring method of a backward flex is shown in FIG. 8B. The backward flex was measured in the same manner as in the forward flex except that the first supporting point 32 was set to a point separated by 12 mm from a tip Tp; the second supporting point 36 was set to a point separated by 152 mm from the tip Tp; a load point m2 was set to a point separated by 932 mm from the tip Tp; and a load was set to 1.3 kg.

[Flex Difference of Backward Flex]

The forward flex was measured in four directions (0 degree, 45 degrees, 90 degrees, and 135 degrees). The difference between the maximum value and the minimum value of the obtained data is a flex difference. The less the flex difference is, the higher the uniformity of the forward flex in the circumferential direction is. The flex difference is shown in the following Table 3.

[Shaft Torque]

A back end part of a shaft was nonrotatably fixed by a butt jig, and a tip part of the shaft was grasped by a tip jig. A torque Tr of 13.9 kgf·cm was allowed to act on a position which was 40 mm away from the tip Tp. A torsional angle (degree) of the shaft at the torque action position was defined as a shaft torque. A rotating speed of the tip jig when the torque Tr was loaded was set to be equal to or less than 130 degrees/min, and an axial length between the butt jig and the tip jig was set to 825 mm. When the shaft is deformed by grasping the tip jig or the butt jig, the shaft torque is measured with a core material or the like put in the shaft. The measured values are shown in Table 3. The less the shaft torque is, the higher the torsional rigidity of the shaft is.

[Torsional Breaking Strength]

An SG type torsional test was employed to measure torsional breaking strength. The test is defined by Consumer Product Safety Association. In the test, fixing jigs are first bonded to the both ends of the shaft. Next, a torque is added to the shaft by rotating the tip Tp side jig with the butt Bt side jig fixed. The torsional breaking strength is obtained by multiplying a torque value when the shaft is damaged, by the torsional angle. The results are shown in the following Table 3.

TABLE 1

Laminated constitutions of examples

| Sheets | | Items | Example 1 | Example 2 | Example 3 | Example 4 |
|---|---|---|---|---|---|---|
| a1 | Straight layer (partial layer) | Prepreg | TR350C-125S | TR350C-125S | TR350C-125S | TR350C-125S |
| | | Tension elastic modulus of fiber (t/mm$^2$) | 24 | 24 | 24 | 24 |
| | | winding start position (degree) | 45 | 45 | 45 | 45 |
| a2, a3 | Base bias layer (full length layer) | Prepreg | HRX350C-110S | HRX350C-110S | HRX350C-110S | HRX350C-110S |
| | | Tension elastic modulus of fiber (t/mm$^2$) | 40 | 40 | 40 | 40 |
| | | Fiber angle Af (degree) | ±45 | ±45 | ±45 | ±45 |
| | | winding start position (degree) | 0, 180 | 0, 180 | 0, 180 | 0, 180 |
| a4, a5 | Adjusting bias layer (full length | Prepreg | MRX350C-075R | MRX350C-075R | MRX350C-075R | MR350C-100S |
| | | Tension elastic modulus of | 30 | 30 | 30 | 30 |

TABLE 1-continued

| Laminated constitutions of examples | | | | | | |
|---|---|---|---|---|---|---|
| Sheets | | Items | Example 1 | Example 2 | Example 3 | Example 4 |
| | layer) | fiber (t/mm$^2$) | | | | |
| | | Fiber angle Af (degree) | ±30 | ±30 | ±25 | ±25 |
| | | winding start position (degree) | 90, 270 | 90, 270 | 90, 270 | 90, 270 |
| a6 | Straight layer (full length layer) | Prepreg | MR350C-150S | MR350C-150S | MR350C-150S | MR350C-150S |
| | | Tension elastic modulus of fiber (t/mm$^2$) | 30 | 30 | 30 | 30 |
| | | winding start position (degree) | 135 | 135 | 135 | 135 |
| a7 | Straight layer (full length layer) | Prepreg | TR350C-125S | TR350C-125S | TR350C-125S | TR350C-125S |
| | | Tension elastic modulus of fiber (t/mm$^2$) | 24 | 24 | 24 | 24 |
| | | winding start position (degree) | 225 | 225 | 225 | 225 |
| a8 | Straight layer (partial layer) | Prepreg | TR350C-100S | TR350C-100S | TR350C-100S | TR350C-100S |
| | | Tension elastic modulus of fiber (t/mm$^2$) | 24 | 24 | 24 | 24 |
| | | winding start position (degree) | 315 | 315 | 315 | 315 |
| | Laminating of bias layers | | a2 + a3, a4 + a5 | a2 + a3 + a4 + a5 | a2 + a3, a4 + a5 | a2 + a3, a4 + a5 |

TABLE 2

| Laminated constitutions of comparative examples | | | | | |
|---|---|---|---|---|---|
| Sheets | | Items | Comparative example 1 | Comparative example 2 | Comparative example 3 |
| a1 | Straight layer (partial layer) | Prepreg | TR350C-125S | TR350C-125S | TR350C-125S |
| | | Tension elastic modulus of fiber (t/mm$^2$) | 24 | 24 | 24 |
| | | winding start position (degree) | 0 | 0 | 0 |
| a2, a3 | Base bias layer (full length layer) | Prepreg | HRX350C-130S | HRX350C-110S | HRX350C-110S |
| | | Tension elastic modulus of fiber (t/mm$^2$) | 40 | 40 | 40 |
| | | Fiber angle Af (degree) | ±45 | ±45 | ±45 |
| | | winding start position (degree) | 0, 180 | 0, 180 | 0, 180 |
| a4, a5 | Adjusting bias layer (full length layer) | Prepreg | None | None | MRX350C-075R |
| | | Tension elastic modulus of fiber (t/mm$^2$) | | | 30 |
| | | Fiber angle Af (degree) | | | ±30 |
| | | winding start position (degree) | | | 0, 180 |
| a6 | Straight layer (full length layer) | Prepreg | MR350C-150S | MR350C-175S | MR350C-150S |
| | | Tension elastic modulus of fiber (t/mm$^2$) | 30 | 30 | 30 |
| | | winding start position (degree) | 0 | 0 | 0 |
| a7 | Straight layer (full length layer) | Prepreg | TR350C-150S | TR350C-175S | TR350C-125S |
| | | Tension elastic modulus of fiber (t/mm$^2$) | 24 | 24 | 24 |
| | | winding start position (degree) | 90 | 90 | 90 |
| a8 | Straight layer (partial layer) | Prepreg | TR350C-100S | TR350C-100S | TR350C-100S |
| | | Tension elastic modulus of fiber (t/mm$^2$) | 24 | 24 | 24 |
| | | winding start position (degree) | 270 | 270 | 270 |
| | Laminating of bias layers | | a2 + a3 | a2 + a3 | a2 + a3, a4 + a5 |

TABLE 3

Evaluation results of examples and comparative examples

| | | Example 1 | Example 2 | Example 3 | Example 4 | Comparative example 1 | Comparative example 2 | Comparative example 3 |
|---|---|---|---|---|---|---|---|---|
| Weight (g) | | 60 | 60 | 60 | 63 | 60 | 60 | 60 |
| Shaft torque (degree) | | 5.0 | 5.0 | 5.2 | 5.0 | 4.9 | 6.0 | 5.0 |
| Torsional breaking strength (N · m · deg) | | 1460 | 1430 | 1390 | 1450 | 1160 | 910 | 1450 |
| Flex difference (mm) | Forward flex | 0.9 | 0.7 | 1.0 | 0.9 | 2.7 | 3.1 | 1.9 |
| | Backward flex | 1.1 | 1.0 | 1.0 | 1.2 | 3.8 | 3.9 | 2.4 |

As shown in the flex difference of Table 3, the flex uniformity in the circumferential direction in examples is higher than those in comparative examples. On the other hand, particularly, the flex uniformity in the circumferential direction in comparative examples 1 and 2 is low. Since the two bias sheets are used in comparative examples 1 and 2, comparative examples 1 and 2 have a great flex difference. The four bias sheets are used in comparative example 3. However, since the dispersion of the winding start positions is restricted to two positions in comparative example 3, comparative example 3 has a comparatively great flex difference.

Although only the two bias sheets are used in comparative example 1, the shaft torque of comparative example 1 is equivalent to those of examples 1 to 4. This is because "HRX350C-130S" having a great fiber weight basis amount is used for the bias sheet of comparative example 1. However, the torsional breaking strength of comparative example 1 is lower than those of examples. This is because the bias sheet includes only a high elastic prepreg having relatively low tensile strength.

In example 2, the united sheet obtained by laminating the four sheets was used. The laminated constitution shown in FIG. 7 was obtained by the united sheet. The laminated constitution has uniformity higher than the laminated constitution shown in FIG. 5. Therefore, example 2 has a flex difference less than that of example 1.

In example 3, the shaft torque was increased by 0.2 degree by setting the fiber angle Af to ±25 degrees. Thus, in example 3, the fine adjustment of the shaft torque is attained while the number of plies of the bias layer is substantially set to an integer. The adjusting layer can play the role for finely adjusting shaft specifications. As shown in example 3, both the flex uniformity in the circumferential direction and the fine adjustment of the shaft specifications can be achieved.

In example 4, the fiber angle Af of the adjusting layer was changed to ±25 degrees, and the weight basis amount (weight per unit area) of the bias layer was increased as compared with example 1. As a result, a shaft weight could be increased by 3 g without changing the shaft torque. In example 4, the shaft weight could be finely adjusted while the number of plies of the bias layer was substantially set to the integer. As shown in example 4, both the flex uniformity in the circumferential direction and the fine adjustment of the shaft specifications can be achieved.

The method described above can be applied to the golf club shaft.

The description hereinabove is merely for an illustrative example, and various modifications can be made in the scope not to depart from the principles of the present invention.

What is claimed is:

1. A golf club shaft manufactured using a plurality of prepreg sheets, wherein the plurality of prepreg sheets comprises full length sheets disposed all over in a shaft axis direction and a partial sheet or partial sheets partially disposed in the shaft axis direction;

the number of plies is substantially an integer in all the full length sheets;

the full length sheets comprise four or more bias sheets;

circumferential winding start positions of the bias sheets are dispersed in four or more positions;

the bias sheets have two base sheets (a first base sheet and a second base sheet) and two adjusting sheets (a first adjusting sheet and a second adjusting sheet);

the two base sheets have an absolute fiber angle θb of 40 degrees or greater and 50 degrees or less;

the two adjusting sheets have an absolute fiber angle θt of 15 degrees or greater and 75 degrees or less, and the absolute fiber angle θt is less than the absolute fiber angle θb; and if the circumferential winding start position of the first base sheet is defined as Pa; the circumferential winding start position of the second base sheet is defined as Pb; the circumferential winding start position of the first adjusting sheet is defined as Pc; and the circumferential winding start position of the second adjusting sheet is defined as Pd, each of the positions Pa, Pb, Pc, and Pd corresponds to any one of the following four circumferential positions P1, P2, P3, and P4 in a one-to-one manner:

the circumferential position P1: 0 degrees;

the circumferential position P2: 75 degrees or greater and 105 degrees or less;

the circumferential position P3: 165 degrees or greater and 195 degrees or less; and the circumferential position P4: 255 degrees or greater and 285 degrees or less.

2. The golf club shaft according to claim 1, wherein circumferential winding start positions of the full length sheets are dispersed in five or more positions.

3. The golf club shaft according to claim 1, wherein the partial sheets comprise long partial sheets having a shaft axial length equal to or greater than 300 mm; and the number of plies is substantially an integer in all the long partial sheets.

4. The golf club shaft according to claim 1, wherein the golf club shaft is manufactured using an united sheet obtained by laminating four sheets; and the four sheets are the two base sheets and the two adjusting sheets.

5. The golf club shaft according to claim 1, wherein the circumferential winding start positions of all the full length sheets are different by equal to or greater than 40 degrees±15 degrees.

6. The golf club shaft according to claim 1, wherein the circumferential winding start positions of the plurality of prepreg sheets are equal to or less than eight positions.

7. The golf club shaft according to claim 1, wherein the bias sheets have two base sheets and two adjusting sheets;

a fiber in the base sheet and the adjusting sheet is a carbon fiber; and an elastic modulus of the carbon fiber of the adjusting sheet is less than an elastic modulus of the carbon fiber of the base sheet.

8. A golf club shaft manufactured using a plurality of prepreg sheets, wherein the plurality of prepreg sheets comprises full length sheets disposed all over in a shaft axis direction and a partial sheet or partial sheets partially disposed in the shaft axis direction;

the number of plies is substantially an integer in all the full length sheets;

the full length sheets comprise four or more bias sheets;

circumferential winding start positions of the bias sheets are dispersed in four or more positions; and the circumferential winding start positions of all the prepreg sheets are different by equal to or greater than 40 degrees.

9. A golf club shaft manufactured using a plurality of prepreg sheets, wherein the plurality of prepreg sheets comprises full length sheets disposed all over in a shaft axis direction and a partial sheet or partial sheets partially disposed in the shaft axis direction;

the number of plies is substantially an integer in all the full length sheets;

the full length sheets comprise four or more bias sheets;

circumferential winding start positions of the bias sheets are dispersed in four or more positions;

the bias sheets have two base sheets (a first base sheet and a second base sheet) and two adjusting sheets (a first adjusting sheet and a second adjusting sheet);

the two base sheets have an absolute fiber angle θb of 40 degrees or greater and 50 degrees or less;

the two adjusting sheets have an absolute fiber angle θt of 15 degrees or greater and 75 degrees or less, and the absolute fiber angle θt is different from the absolute fiber angle θb; and if the circumferential winding start position of the first base sheet is defined as Pa; the circumferential winding start position of the second base sheet is defined as Pb; the circumferential winding start position of the first adjusting sheet is defined as Pc; and the circumferential winding start position of the second adjusting sheet is defined as Pd, each of the positions Pa, Pb, Pc and Pd corresponds to any one of the following four circumferential positions P1, P2, P3, and P4 in a one-to-one manner:

the circumferential position P1: 0 degrees;

the circumferential position P2: 75 degrees or greater and 105 degrees or less;

the circumferential position P3: 165 degrees or greater and 195 degrees or less; and the circumferential position P4: 255 degrees or greater and 285 degrees or less; and if position Pa corresponds to position P1, position Pb corresponds to position P3; position Pc corresponds to one of position P2 and position P4; and position Pd corresponds to the other of position P2 and the position P4.

10. A golf club shaft manufactured using a plurality of prepreg sheets, wherein the plurality of prepreg sheets comprises full length sheets disposed all over in a shaft axis direction and a partial sheet or partial sheets partially disposed in the shaft axis direction;

the number of plies is substantially an integer in all the full length sheets;

the full length sheets comprise four or more bias sheets;

circumferential winding start positions of the bias sheets are dispersed in four or more positions;

the bias sheets have two base sheets (a first base sheet and a second base sheet) and two adjusting sheets (a first adjusting sheet and a second adjusting sheet);

the golf club shaft is manufactured using an united sheet obtained by laminating four sheets;

the four sheets are the two base sheets and the two adjusting sheets:

the base sheets and the adjusting sheets are alternately stuck to each other in the united sheet;

the two base sheets have an absolute fiber angle θb of 40 degrees or greater and 50 degrees or less;

the two adjusting sheets have an absolute fiber angle θt of 15 degrees or greater and 75 degrees or less, and the absolute fiber angle θt is different from the absolute fiber angle θb; and if the circumferential winding start position of the first base sheet is defined as Pa; the circumferential winding start position of the second base sheet is defined as Pb; the circumferential winding start position of the first adjusting sheet is defined as Pc; and the circumferential winding start position of the second adjusting sheet is defined as Pd, each of the positions Pa, Pb, Pc, and Pd corresponds to any one of the following four circumferential positions P1, P2, P3, and P4 in a one-to-one manner:

the circumferential position P1: 0 degrees;

the circumferential position P2: 75 degrees or greater and 105 degrees or less;

the circumferential position P3: 165 degrees or greater and 195 degrees or less; and the circumferential position P4: 255 degrees or greater and 285 degrees or less.

11. The golf club shaft according to claim 10, wherein a fiber in the first base sheet and a fiber in the first adjusting sheet in the united sheet are inclined in the same direction with respect to a shaft axis line, and a fiber in the second base sheet and a fiber in the second adjusting sheet are inclined in the same direction with respect to the shaft axis line.

12. A golf club shaft manufactured using a plurality of prepreg sheets, wherein the plurality of prepreg sheets comprises full length sheets disposed all over in a shaft axis direction and a partial sheet or partial sheets partially disposed in the shaft axis direction;

the full length sheets comprise a plurality of bias sheets;

the bias sheets have two base sheets (a first base sheet and a second base sheet) and two adjusting sheets (a first adjusting sheet and a second adjusting sheet);

the two base sheets have an absolute fiber angle θb of 40 degrees or greater and 50 degrees or less;

the two adjusting sheets have an absolute fiber angle θt of 15 degrees or greater and 75 degrees or less, and the angle θt is less than the angle θb; and when the circumferential winding start position of the first base sheet is defined as Pa; the circumferential winding start position of the second base sheet is defined as Pb; the circumferential winding start position of the first adjusting sheet is defined as Pc; and the circumferential winding start position of the second adjusting sheet is defined as Pd, each of the positions Pa, Pb, Pc, and Pd is distributed in any one of the following four circumferential positions P1, P2, P3, and P4:

the circumferential position P1: 0 degree;

the circumferential position P2: 75 degrees or greater and 105 degrees or less;

the circumferential position P3: 165 degrees or greater and 195 degrees or less; and the circumferential position P4: 255 degrees or greater and 285 degrees or less.

13. The golf club shaft according to claim 12, wherein circumferential winding start positions of the full length sheets are dispersed in five or more positions.

14. The golf club shaft according to claim 12, wherein the partial sheets comprise long partial sheets having a shaft axial length equal to or greater than 300 mm; and the number of plies is substantially an integer in all the long partial sheets.

15. The golf club shaft according to claim 12, wherein the golf club shaft is manufactured using an united sheet obtained by laminating four sheets; and the four sheets are the two base sheets and the two adjusting sheets.

16. The golf club shaft according to claim 12, wherein the bias sheets have two base sheets and two adjusting sheets;

a fiber in the base sheet and the adjusting sheet is a carbon fiber; and an elastic modulus of the carbon fiber of the adjusting sheet is less than an elastic modulus of the carbon fiber of the base sheet.

17. A golf club shaft manufactured using a plurality of prepreg sheets, wherein the plurality of prepreg sheets comprises full length sheets disposed all over in a shaft axis direction and a partial sheet or partial sheets partially disposed in the shaft axis direction;

the full length sheets comprise a plurality of bias sheets;

the bias sheets have two base sheets (a first base sheet and a second base sheet) and two adjusting sheets (a first adjusting sheet and a second adjusting sheet);

the two base sheets have an absolute fiber angle θb of 40 degrees or greater and 50 degrees or less;

the two adjusting sheets have an absolute fiber angle θt of 15 degrees or greater and 75 degrees or less, and the angle θt is different from the angle θb; and when the circumferential winding start position of the first base sheet is defined as Pa; the circumferential winding start position of the second base sheet is defined as Pb; the circumferential winding start position of the first adjusting sheet is defined as Pc; and the circumferential winding start position of the second adjusting sheet is defined as Pd, each of the positions Pa, Pb, Pc, and Pd is distributed in any one of the following four circumferential positions P1, P2, P3, and P4:

the circumferential position P1: 0 degrees;

the circumferential position P2: 75 degrees or greater and 105 degrees or less;

the circumferential position P3: 165 degrees or greater and 195 degrees or less; and the circumferential position P4: 255 degrees or greater and 285 degrees or less; and the circumferential winding start positions of all the full length sheets are different by equal to or greater than 40 degrees±15 degrees.

18. The golf club shaft according to claim 17, wherein the golf club shaft is manufactured using an united sheet obtained by laminating four sheets; and the four sheets are the two base sheets and the two adjusting sheets.

19. A golf club shaft manufactured using a plurality of prepreg sheets, wherein the plurality of prepreg sheets comprises full length sheets disposed all over in a shaft axis direction and a partial sheet or partial sheets partially disposed in the shaft axis direction;

the full length sheets comprise a plurality of bias sheets;

the bias sheets have two base sheets (a first base sheet and a second base sheet) and two adjusting sheets (a first adjusting sheet and a second adjusting sheet);

the two base sheets have an absolute fiber angle θb of 40 degrees or greater and 50 degrees or less;

the two adjusting sheets have an absolute fiber angle θt of 15 degrees or greater and 75 degrees or less, and the angle θt is different from the angle θb; and when the circumferential winding start position of the first base sheet is defined as Pa; the circumferential winding start position of the second base sheet is defined as Pb; the circumferential winding start position of the first adjusting sheet is defined as Pc; and the circumferential winding start position of the second adjusting sheet is defined as Pd, each of the positions Pa, Pb, Pc, and Pd is distributed in any one of the following four circumferential positions P1, P2, P3, and P4:

the circumferential position P1: 0 degrees;

the circumferential position P2: 75 degrees or greater and 105 degrees or less;

the circumferential position P3: 165 degrees or greater and 195 degrees or less; and the circumferential position P4: 255 degrees or greater and 285 degrees or less; and the circumferential winding start positions of all the full length sheets are different by equal to or greater than 40 degrees.

20. The golf club shaft according to claim 19, wherein the golf club shaft is manufactured using an united sheet obtained by laminating four sheets; and the four sheets are the two base sheets and the two adjusting sheets.

* * * * *